US012650222B2

(12) United States Patent
Cadima

(10) Patent No.: US 12,650,222 B2
(45) Date of Patent: Jun. 9, 2026

(54) INWARD FIRED RADIAL GAS BURNER ASSEMBLY AND COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 282 days.

(21) Appl. No.: 18/512,308

(22) Filed: Nov. 17, 2023

(65) Prior Publication Data

US 2025/0164105 A1 May 22, 2025

(51) Int. Cl.
*F23D 14/06* (2006.01)

(52) U.S. Cl.
CPC .... *F23D 14/06* (2013.01); *F23D 2900/14004* (2013.01)

(58) Field of Classification Search
CPC ..... F24D 14/06; F23D 2900/14021; F23D 2900/14063; F24C 3/08; F24C 3/082; F24C 3/085
USPC ..... 126/39 E, 39 R, 214 A; 431/354
See application file for complete search history.

(56) References Cited

U.S. PATENT DOCUMENTS

| | | | |
|---|---|---|---|
| 6,132,205 | A | 10/2000 | Harneit |
| 7,819,657 | B2 | 10/2010 | Molla |
| 8,616,193 | B2 | 12/2013 | Padgett |
| 10,415,824 | B2 | 9/2019 | Cadima |
| 10,731,851 | B2 | 8/2020 | Angulo |
| 2014/0090636 | A1 | 4/2014 | Bettinzoli |
| 2015/0040887 | A1 | 2/2015 | Angulo |
| 2017/0205075 | A1* | 7/2017 | Cadima ..... F24C 15/107 |

FOREIGN PATENT DOCUMENTS

| | | | |
|---|---|---|---|
| CN | 201680370 | U | 12/2010 |
| CN | 107525072 | A | 12/2017 |
| CN | 111256120 | B | 12/2021 |
| WO | WO2014127724 | A2 | 8/2014 |

* cited by examiner

*Primary Examiner* — Vivek K Shirsat
(74) *Attorney, Agent, or Firm* — Dority & Manning, P.A.

(57) ABSTRACT

A burner assembly for a cooktop appliance is provided, including an annular burner body forming a plurality of flame ports distributed in adjacent arrangement along a circumferential direction and extending radially inward from a mixing chamber formed at the annular burner body and substantially surrounding a central combustion zone. The plurality of flame ports form a swirl angle extending between an inlet opening proximate to the mixing chamber and an outlet opening distal to the mixing chamber and adjacent to the central combustion zone. The plurality of flame ports extend at an angle greater than zero degrees and less than 90 degrees. The annular burner body includes an inner side wall at which the outlet opening of the plurality of flame ports is formed. A recess is formed at the inner side wall between a circumferentially adjacent pair of flame ports.

18 Claims, 10 Drawing Sheets

INWARD FIRED RADIAL GAS BURNER ASSEMBLY AND COOKTOP APPLIANCE

FIELD

The present subject matter relates generally to cooktop appliances with gas burner assemblies, such as gas range appliances or gas stove appliances.

BACKGROUND

Certain cooktop appliances include gas burners for heating cooking utensils on the cooktop appliances. Gas burners that fire inwards, typically with a swirling flame pattern, may offer better efficiency than traditional outward firing gas burners. However, known inward firing gas burners have various drawbacks. One such drawback is that inward firing burners have a limited combustion zone size compared to outward firing burners that can extend radially outward indefinitely in order to entrain air. Combustion efficiency and power density of inward firing burners can decline significantly if over fired.

Accordingly, a cooktop appliance and inward firing burner addressing one or more of these issues would be advantageous and beneficial.

BRIEF DESCRIPTION

Aspects and advantages of the invention will be set forth in part in the following description, or may be obvious from the description, or may be learned through practice of the invention.

An aspect of the present disclosure is directed to a burner assembly for a cooktop appliance. The burner assembly includes an annular burner body forming a plurality of flame ports distributed in adjacent arrangement along a circumferential direction and extending radially inward from a mixing chamber formed at the annular burner body and substantially surrounding a central combustion zone. The plurality of flame ports form a swirl angle extending between an inlet opening proximate to the mixing chamber and an outlet opening distal to the mixing chamber and adjacent to the central combustion zone. The plurality of flame ports extend at an angle greater than zero degrees and less than 90 degrees. The annular burner body includes an inner side wall at which the outlet opening of the plurality of flame ports is formed. A recess is formed at the inner side wall between a circumferentially adjacent pair of flame ports.

Another aspect of the present disclosure is directed to a cooktop appliance including a cabinet configured to receive an inward fired burner assembly. The inward fired burner assembly includes an annular burner body forming a plurality of flame ports distributed in adjacent arrangement along a circumferential direction and extending radially inward from a mixing chamber formed at the annular burner body and substantially surrounding a central combustion zone. The plurality of flame ports form a swirl angle extending between an inlet opening proximate to the mixing chamber and an outlet opening distal to the mixing chamber and adjacent to the central combustion zone. The plurality of flame ports extend at an angle greater than zero degrees and less than 90 degrees. The annular burner body includes an inner side wall at which the outlet opening of the plurality of flame ports is formed, A recess is formed at the inner side wall between a circumferentially adjacent pair of flame ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
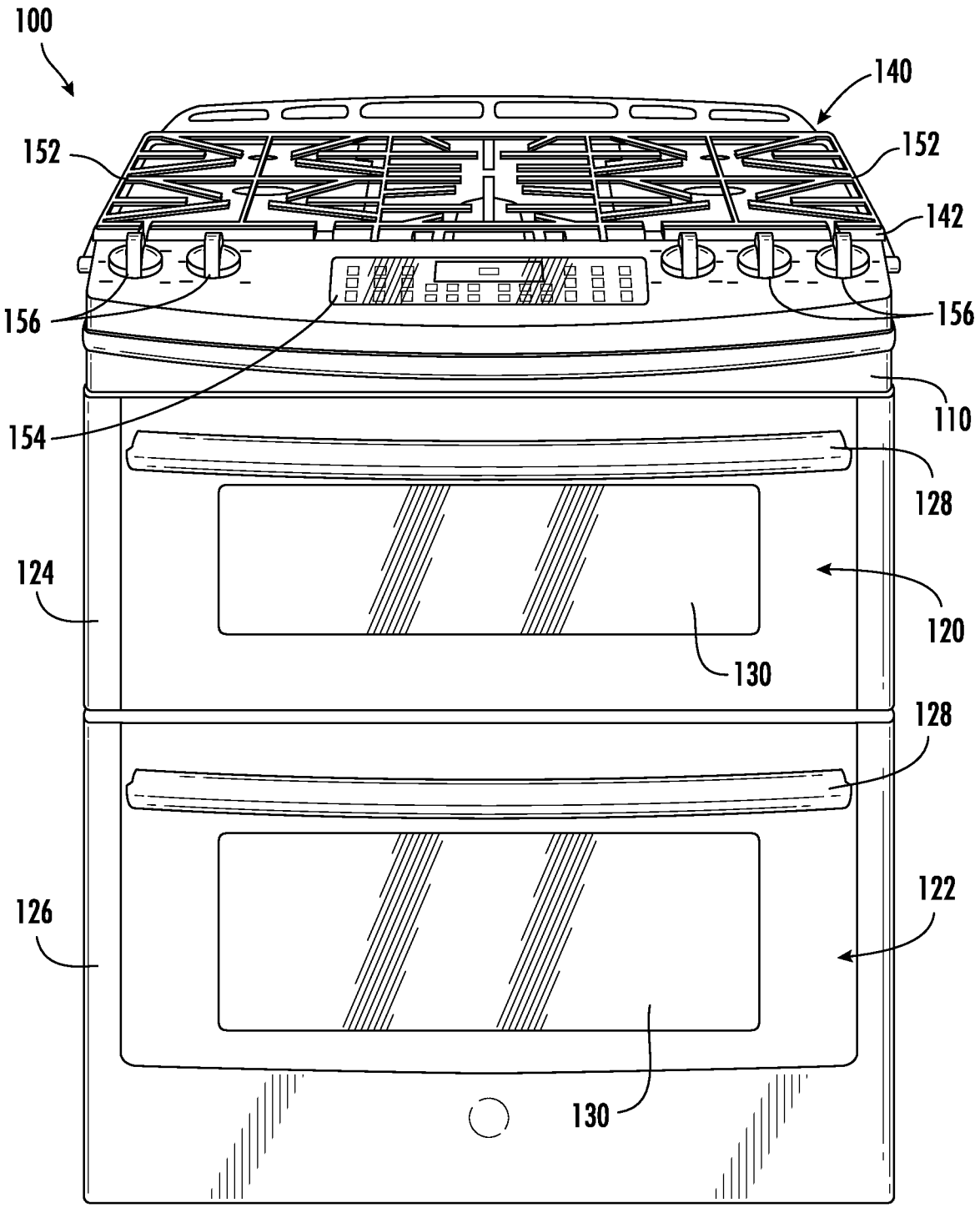
FIG. 1 provides a front, perspective view of a range appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
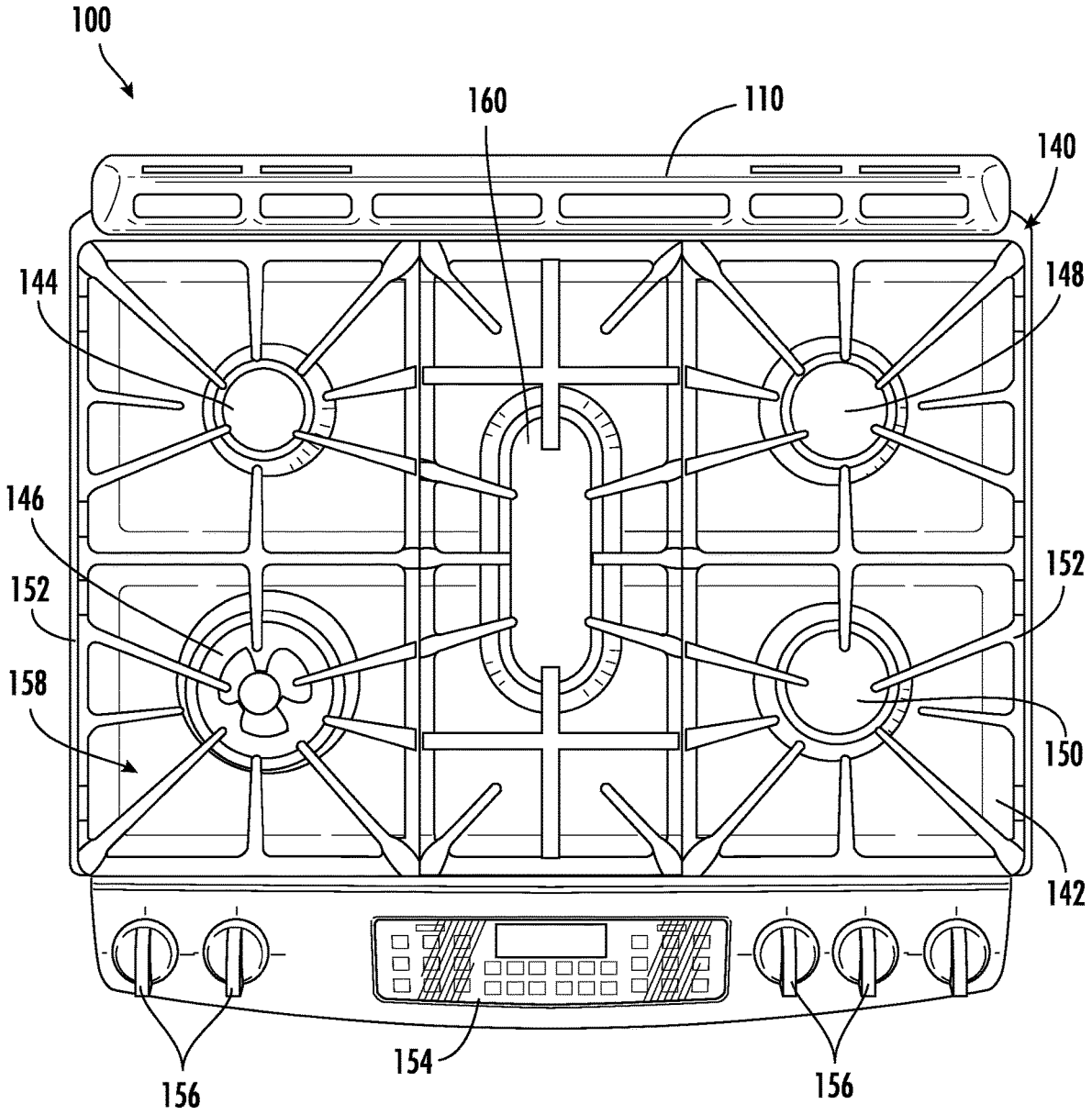
FIG. 2 provides a top, plan view of the exemplary range appliance of FIG. 1.
Figure 3:
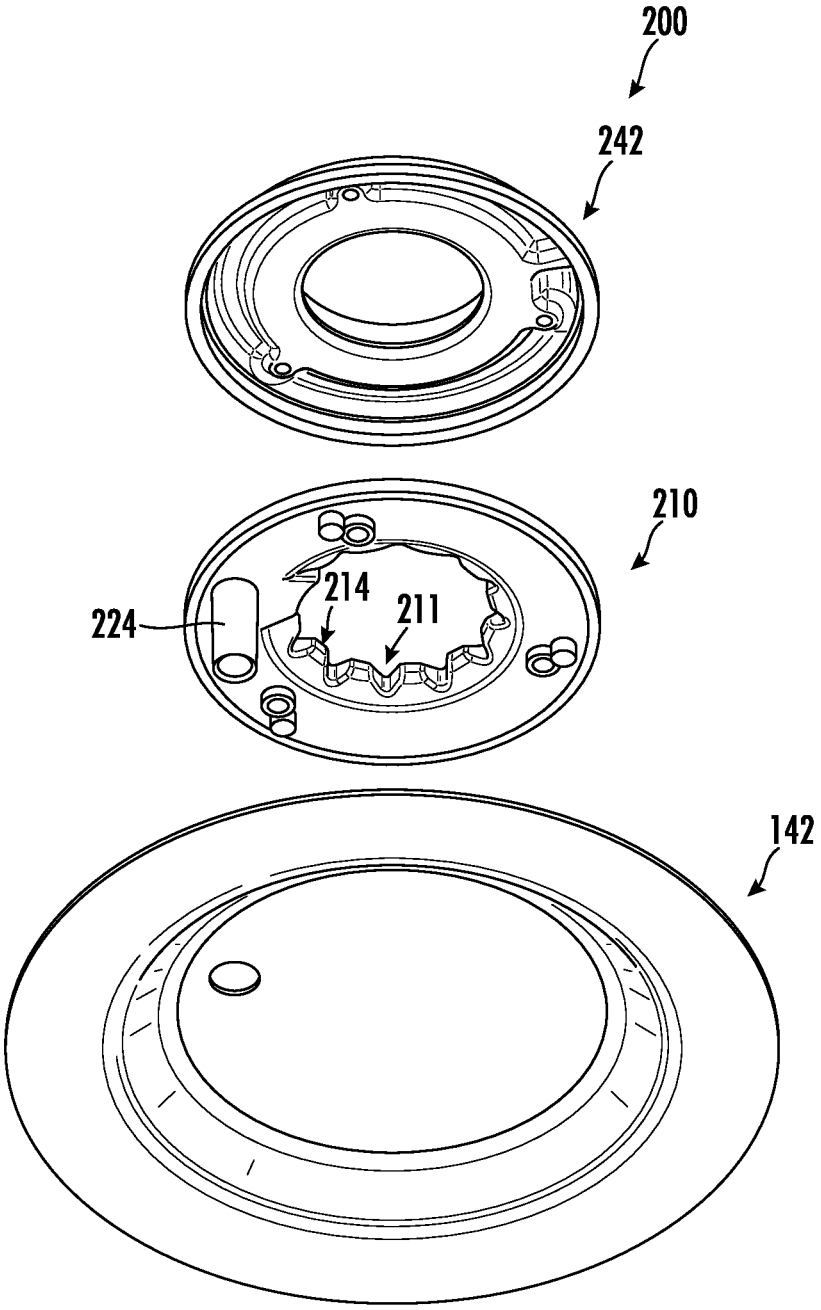
FIG. 3 provides an exploded view of an exemplary embodiment of an inward-fired burner assembly in accordance with aspects of the present disclosure.
Figure 4:
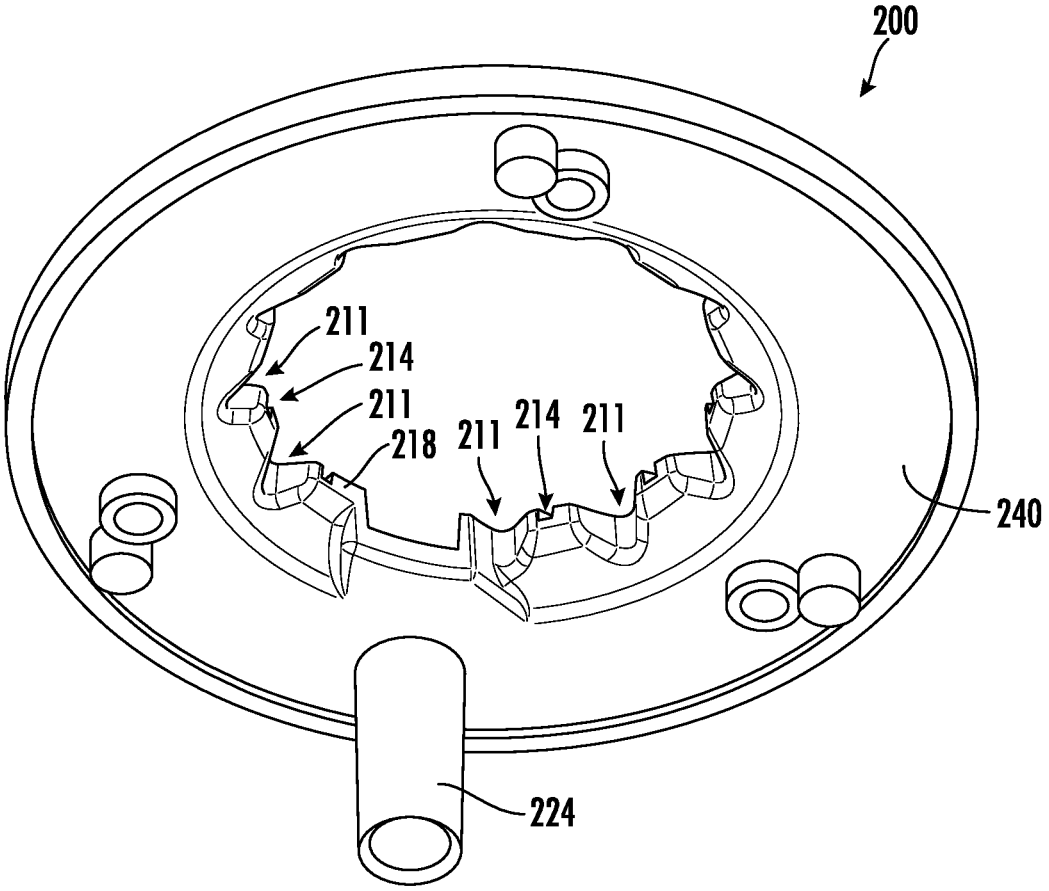
FIG. 4 provides a bottom-up perspective view of a portion of an exemplary embodiment of an inward-fired burner assembly in accordance with aspects of the present disclosure.
Figure 5:
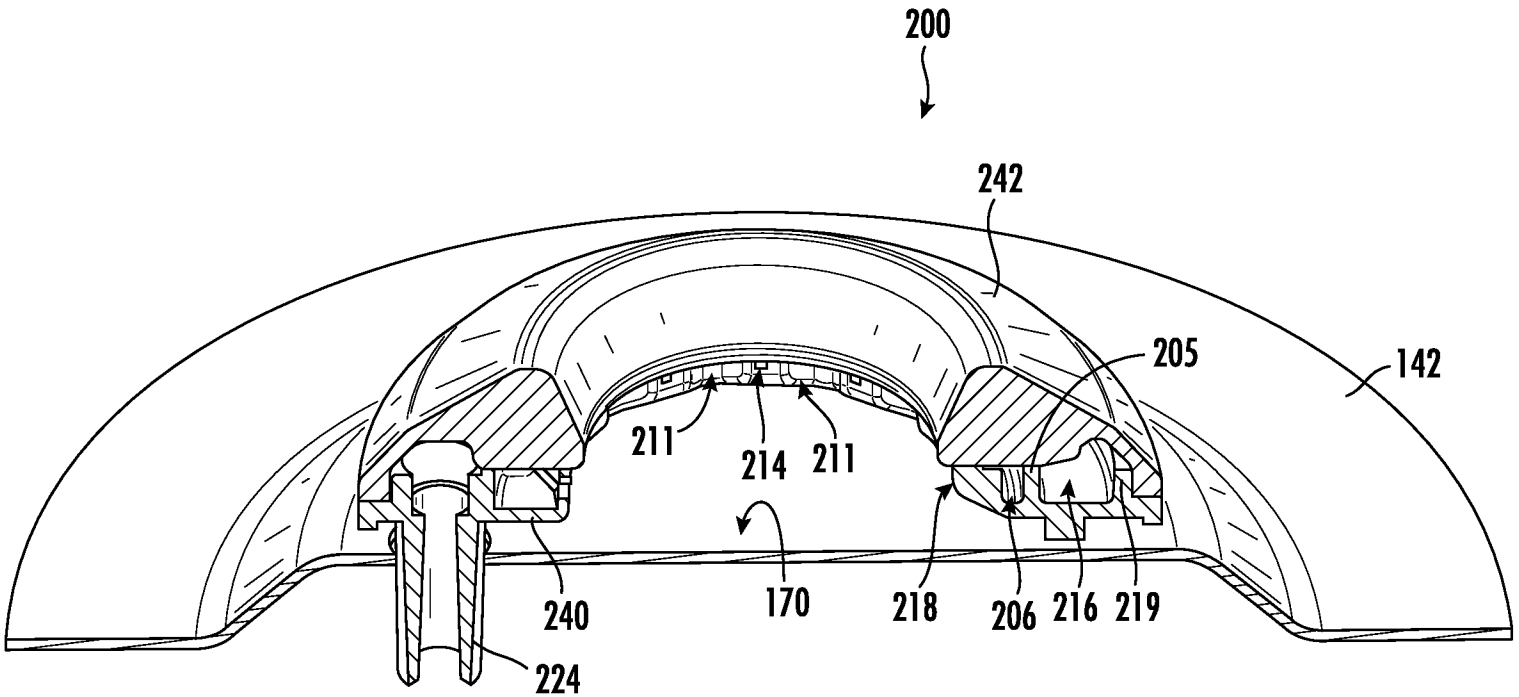
FIG. 5 provides a cutaway perspective view of an exemplary embodiment of an inward-fired burner assembly in accordance with aspects of the present disclosure.
Figure 6:
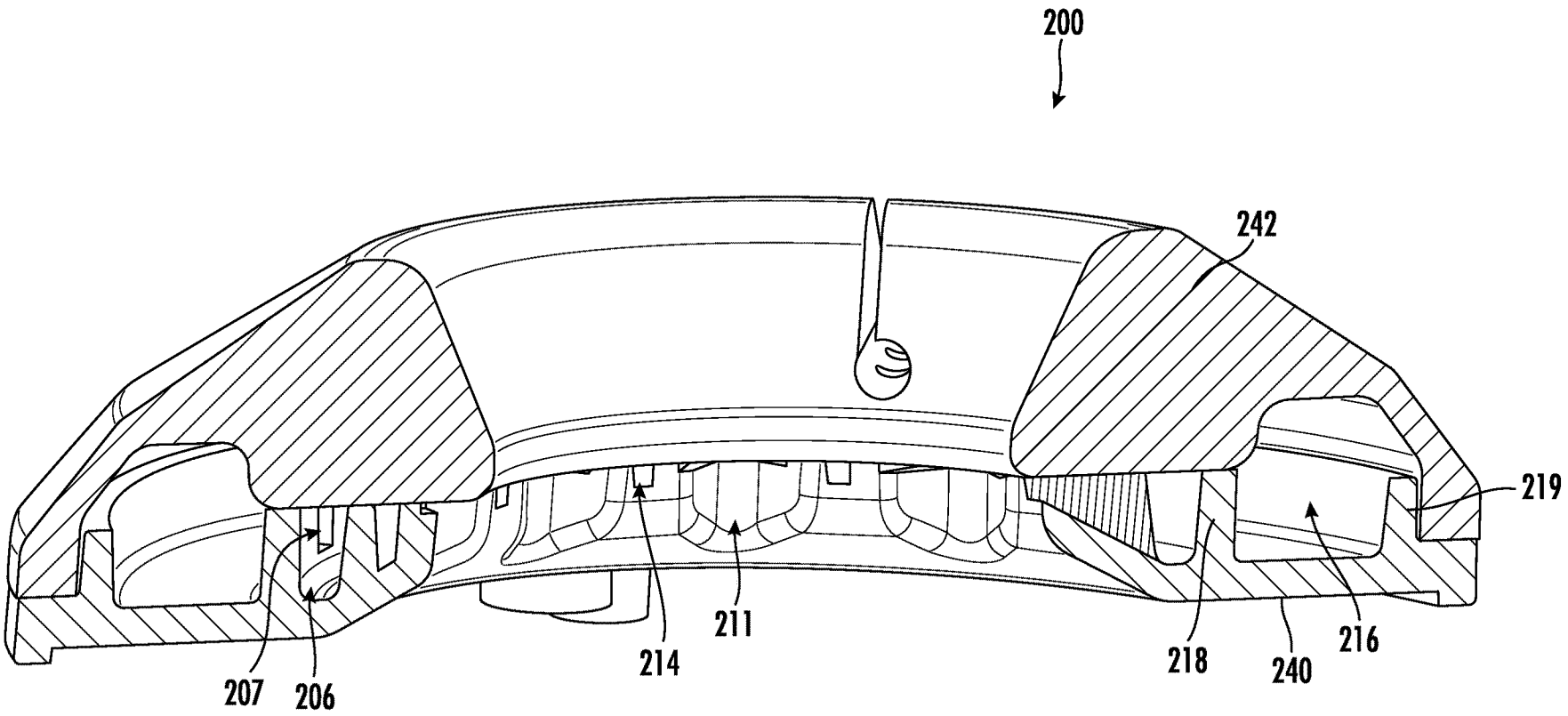
FIG. 6 provides a cutaway perspective view of an exemplary embodiment of an inward-fired burner assembly in accordance with aspects of the present disclosure.
Figure 7:
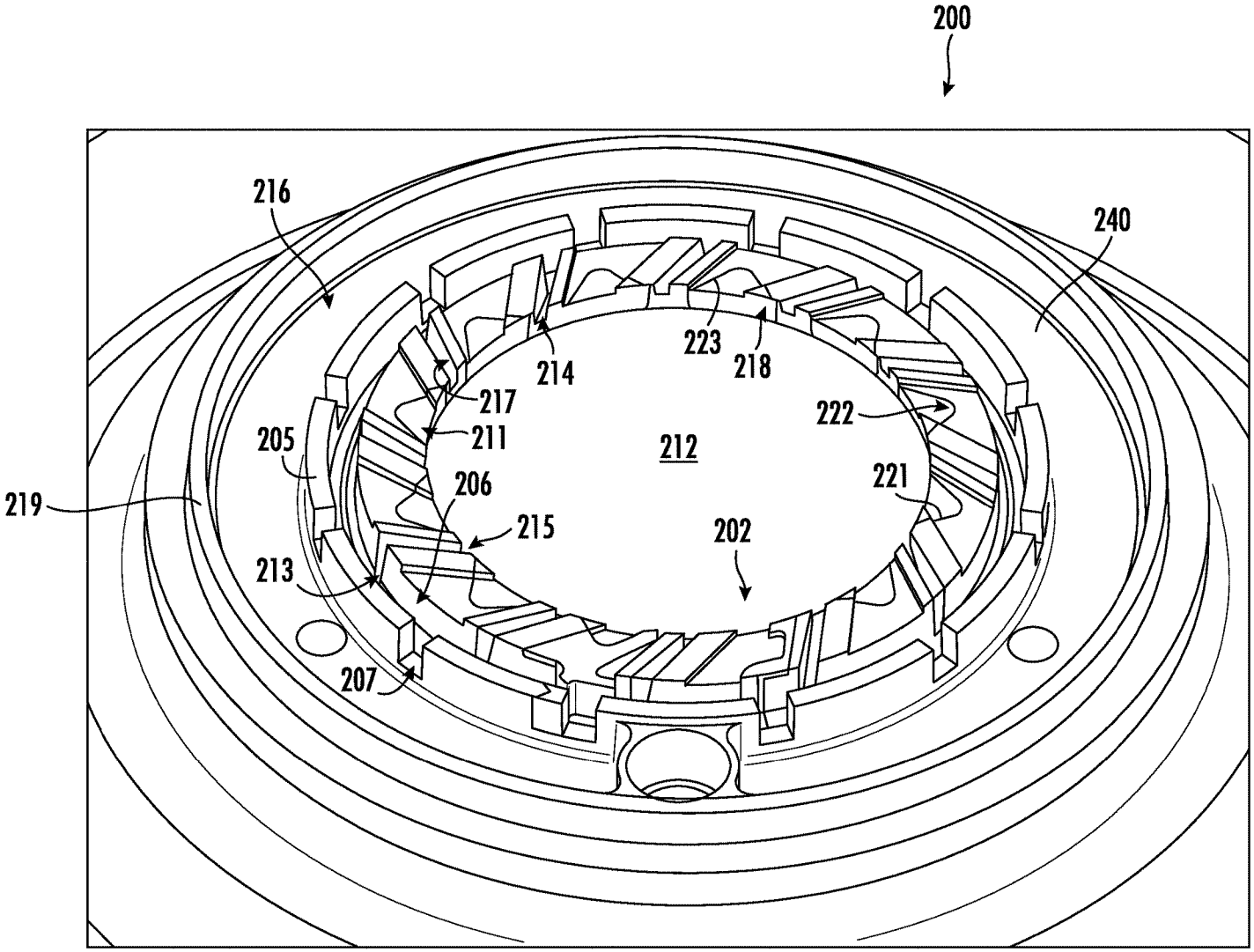
FIG. 7 provides a perspective internal view of a portion of an exemplary embodiment of an inward-fired burner assembly in accordance with aspects of the present disclosure.
Figure 8:
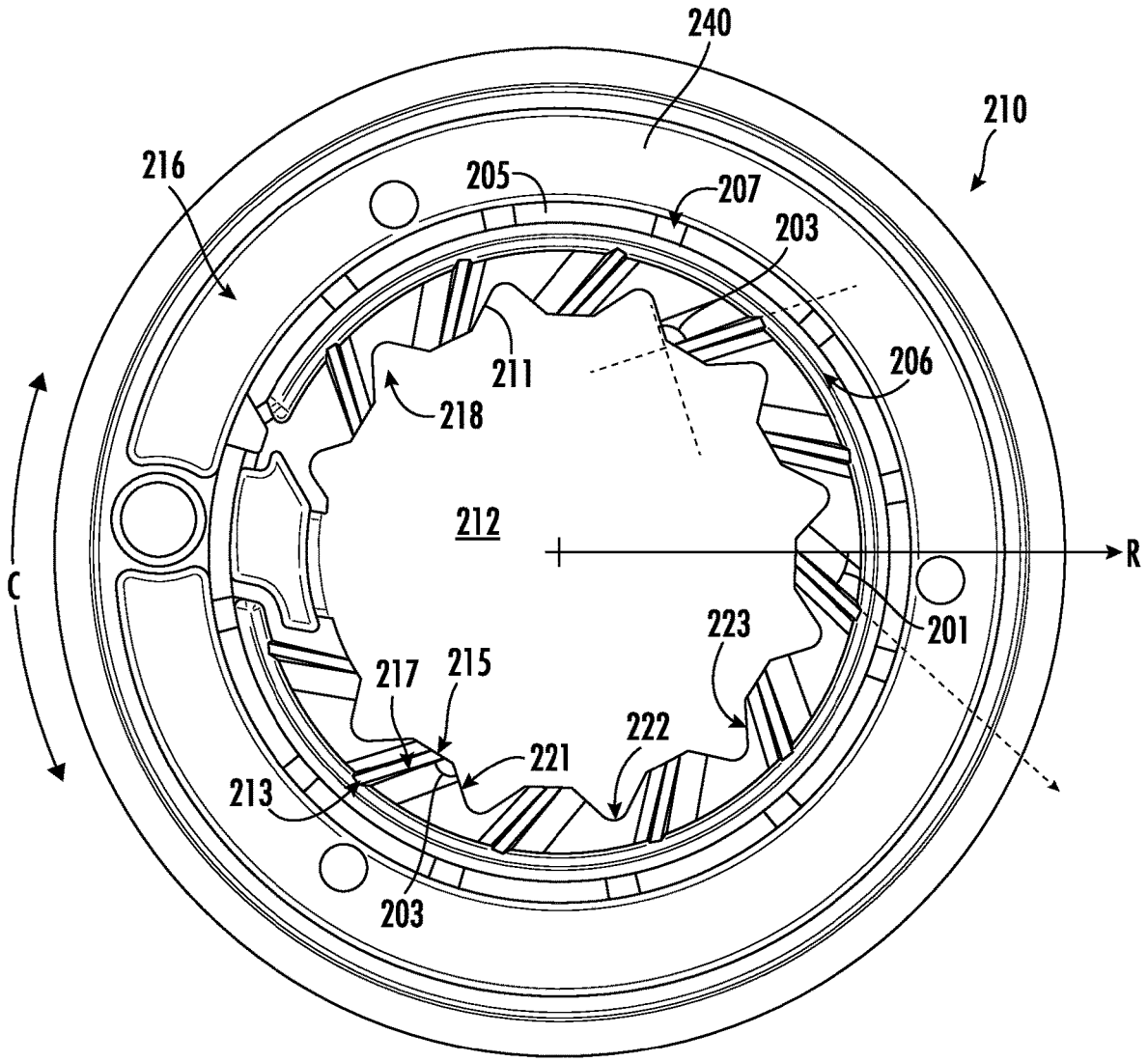
FIG. 8 provides a top-down internal view of a portion of an exemplary embodiment of an inward-fired burner assembly in accordance with aspects of the present disclosure.
Figure 9:
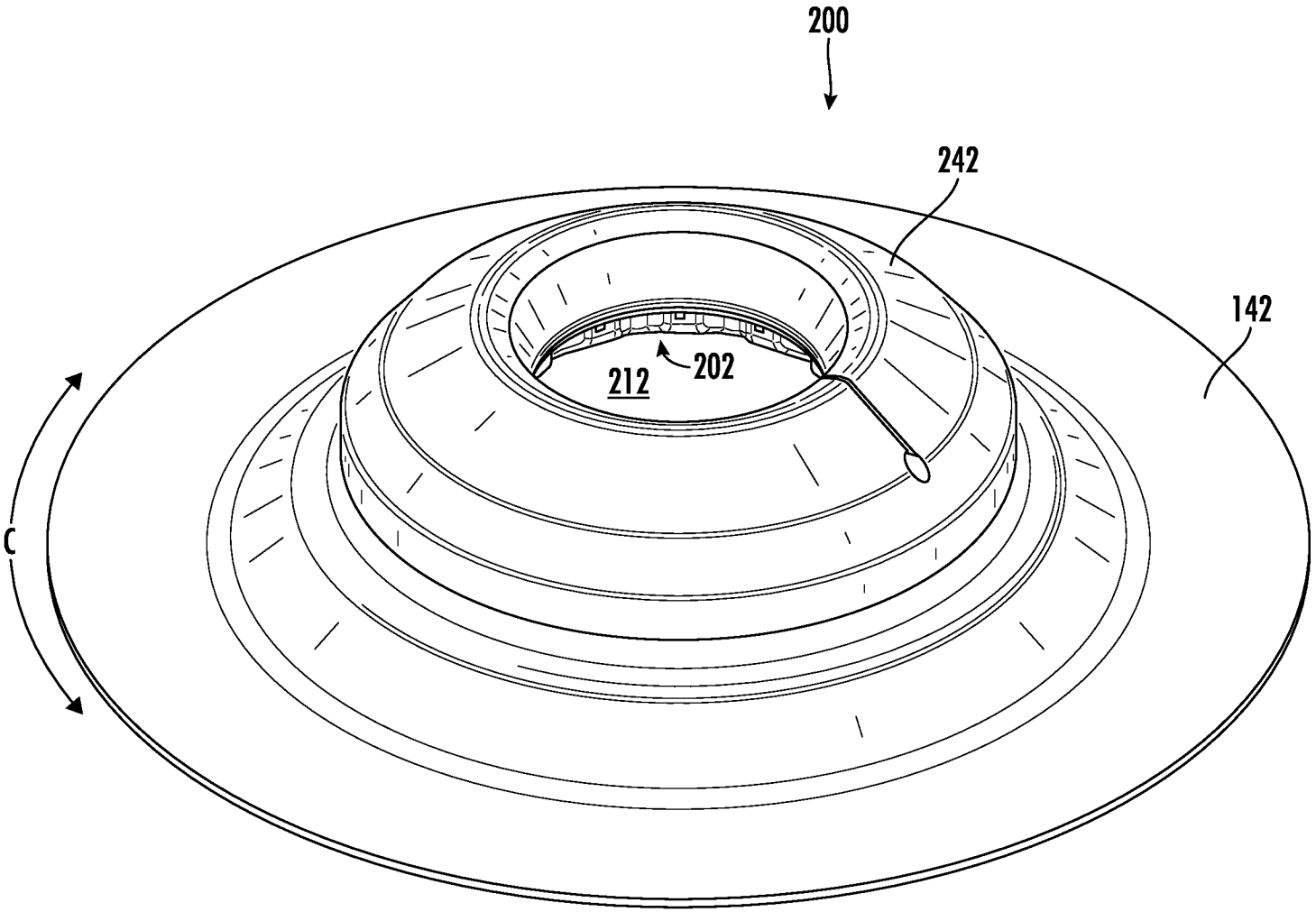
FIG. 9 provides a perspective view of an exemplary embodiment of an inward-fired burner assembly in accordance with aspects of the present disclosure.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3 through 10, various views are provided of a gas burner assembly 200 according to an exemplary embodiment of the present disclosure. As an example, burner assembly 200 may be used in range appliance 100 (FIG. 2) as one of burner assemblies 144, 146, 148, 150, 160. Nonetheless, it will be understood that, while described in greater detail below in the context of range appliance 100 or cooktop 140, burner assembly 200 may be used in or with any suitable appliance in alternative exemplary embodiments.

Generally, burner assembly 200 includes an inner burner ring 202. Inner burner ring 202 is inward firing, such as with a swirling flame pattern. As discussed in greater detail below, burner assembly 200 includes features for managing or mitigating heat at top panel 142 (e.g., to prevent damage thereto). Burner assembly 200 defines an axial direction A, a radial direction R, and a circumferential direction C.

When assembled, burner assembly 200 may be positioned at top panel 142. As noted above, top panel 142 may include multiple discrete elements or, alternatively, a single integral unitary piece (e.g., formed from sheet metal). Thus, burner assembly 200 may be positioned at a specific separable portion of top panel 142 (e.g., a mounting pan mounted to or supported on a support plate of top panel 142).

Burner assembly 200 includes an annular burner body 210. Annular burner body 210 may be positioned on top panel 142 at a top surface 170 of top panel 142. For example, annular burner body 210 may rest on top panel 142 at top surface 170 of top panel 142 such that annular burner body 210 is not fastened or otherwise mechanically fixed to top panel 142. Thus, a user may simply lift annular burner body 210 upwardly away from top panel 142 to remove annular burner body 210 from top panel 142.

Annular burner body 210 defines a central combustion zone 212. Annular burner body 210 also defines a plurality of flame ports 214 (e.g., at or facing central combustion zone 212). Flame ports 214 may be distributed, for example, along the circumferential direction C, about central combustion zone 212. Gaseous fuel is thus flowable from mixing chamber 216 within annular burner body 210 into central combustion zone 212 through flame ports 214. Flame ports 214 are oriented such that the gaseous fuel flows in a swirling pattern from flame ports 214 into central combustion zone 212. The flame ports 214 form a swirl angle relative to a centerline extending between openings 213, 215 and a radial direction R extending from a center point of the annular burner body 210, such as depicted at angle 201.

Angle 201 may be relative to a centerline of the flame port 214 extending through the outlet opening 215, or additionally, an outlet opening vector, and the radial direction R. Angle 201 may extend greater than zero degrees and less than 90 degrees. In various embodiments, angle 201 extends between approximately 10 degrees and approximately 60 degrees. In still various embodiments, angle 201 extends between approximately 20 degrees and approximately 50 degrees. In still yet various embodiments, angle 201 is approximately 30 degrees+/−20 degrees.

In various embodiments, annular burner body 210 includes an inner side wall 218 and an outer side wall 219. Inner side wall 218 may extend around central combustion zone 212 (e.g., along the circumferential direction C). Flame ports 214 may be formed on or extend through inner side wall 218 (e.g., along the radial direction R, between mixing chamber 216 and central combustion zone 212). Outer side wall 219 may extend around inner side wall 218 (e.g., along the circumferential direction C). Outer side wall 219 may also be spaced from inner side wall 218 (e.g., along the radial direction R). Mixing chamber 216 is positioned between inner and outer side walls 218, 219 (e.g., along the radial direction R, within annular burner body 210). Annular burner body 210 is open at central combustion zone 212. For example, no portion or component of annular burner body 210 may extend (e.g., inward or otherwise along the radial direction R) into central combustion zone 212. In some embodiments, no fuel-providing structure extends into the central combustion zone 212.

Top panel 142 may be exposed through annular burner body 210 at central combustion zone 212. For instance, a circumferentially bounded portion of top panel 142 (e.g., bounded by annular burner body 210) may be exposed along the vertical direction. In such a manner, spills from utensils above burner assembly 200 may flow through central combustion zone 212 to top panel 142, and such spills may pass through burner assembly 200 without contacting burner assembly 200 at central combustion zone 212. Staining of annular burner body 210 may be reduced or limited by allowing spills to pass through annular burner body 210 at central combustion zone 212.

Annular burner body 210 may include an annular burner base 240 and an annular burner head 242. Annular burner base 240 includes inlet passages 230 and may be positioned on or over top panel 142. Annular burner head 242 may be positioned on annular burner base 240 to form mixing chamber 216 of annular burner body 210. Thus, annular burner base 240 may form a bottom wall of mixing chamber 216, and annular burner head 242 may form a top wall of mixing chamber 216. Annular burner base 240 or annular burner head 242 may be formed of a cast metal, such as cast iron or cast aluminum alloy.

Top panel 142 may also be continuous or imperforate directly below central combustion zone 212. Thus, spills passing through central combustion zone 212 may collect on top panel 142 and not flow through top panel 142. A user may easily access and clean such spills on top panel 142 by removing annular burner body 210 from top panel 142. In such a manner, burner assembly 200 may facilitate cleaning of spills from utensils positioned over burner assembly 200.

In some embodiments, a volume 206 is formed between the mixing chamber 216 and the flame ports 214. Volume 206 may extend concentrically to the mixing chamber 216, such as radially between the mixing chamber 216 and an inlet opening 213 into the flame port 214. For instance, a wall 205 may extend to form the volume 206 between the inner side wall 218 and the mixing chamber 216. An opening 207 is formed at the wall 205 to provide fluid communication between the mixing chamber 216 and the volume 206. An outlet opening 215 is formed at the flame port 214 at the central combustion zone 212. For instance, outlet opening 215 may be formed at the inner side wall 218 adjacent to the central combustion zone 212. Inlet opening 213 may be formed at the inner burner ring 202 adjacent to the volume 206.

Embodiments of the inward fired burner assembly 200 include a recess 211 formed at the inner side wall 218. The recess 211 is formed adjacent along the circumferential direction C to each flame port 214. For instance, the recess 211 may be formed on a leading side of the flame port 214. The recess 211 forms a channel configured to provide secondary air entrainment to the leading side of each flame formed by the flame port 214. For instance, from a top view, a flame ring geometry formed during operation of burner assembly 200 may form a sawtooth pattern extending from the plurality of flame ports 214. During operation of the burner assembly 200, a top edge of the recesses 211 may be formed substantially perpendicular to the angle 201 of the flame port 214. At the origin of the flame adjacent the outlet opening 215, air entrainment may be comparable to that of an outward fired port burner assembly.

In some embodiments, recess 211 forms a first wall 221 extending from a first outlet opening 215 and outward along the radial direction R before reaching a nadir 222 from which a second wall 223 extends toward a second outlet opening 215 circumferentially adjacent to the first outlet opening 215. In various embodiments, the first wall 221 extends from a leading edge of the outlet opening 215 and the second wall 223 extends to a trailing edge of the outlet opening 215, such as relative to a swirl direction of the flames. An angle 203 between an inner wall 217 of the flame port 214 extending between the openings 213, 215 is between approximately 75 degrees and approximately 100 degrees relative to the first wall 221. In some embodiments, the angle 203 is between approximately 90 degrees (e.g., 90 degrees +10 degrees, −15 degrees). In still some embodiments, the angle 203 is relative to a centerline extending through the flame port 214 and a middle 50% portion (e.g., a straight portion) of the first wall 221.

In some embodiments, the flame port 214 extending is substantially straight between openings 213, 215. In still some embodiments, the flame port 214 extends for a distance approximately double or greater of a hydraulic diameter of the outlet opening 215. For instance, inner wall 217 may extend for a distance at least equal to the hydraulic diameter of the outlet opening 215.

Figure 10:
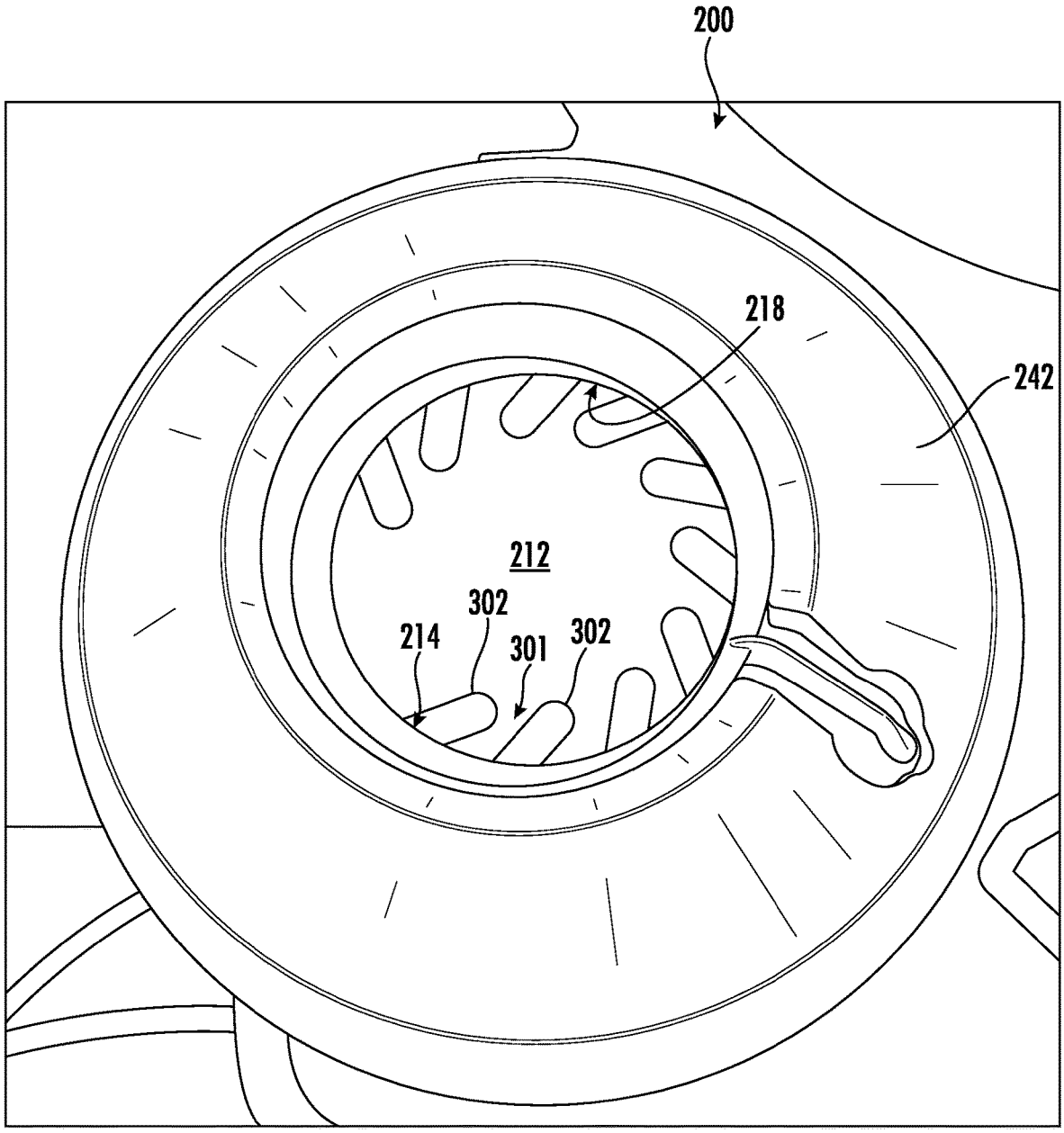
FIG. 10 provides a perspective view of an exemplary embodiment operation of an inward-fired burner assembly in accordance with aspects of the present disclosure.

In various embodiments of the burner assembly 200, during operation, such as depicted in FIG. 10, a substantially uniform reaction zone is formed around a circumference of the plurality of flames extending from the flame ports 214. Additionally, during operation of embodiments of the burner assembly 200 such as described herein, the burner assembly 200 may form clear spacing between adjacent flames, such as depicted as gap 301 between flames 302. Still further, an inner cone may become invisible at the flames, such as may be indicative of flame fronts entraining air early and having a constrained combustion zone.

Embodiments of the burner assembly 200 depicted and described herein may further include a fuel manifold or other structure for providing fuel to the mixing chamber 216, such as via a tube 224. Tube 224 may form a Venturi mixing tube, such as may entrain air and gaseous fuel from outside of the burner body 210 and pull into the mixing chamber 216. Embodiments of the burner assembly 200 may further include a fuel manifold assembly configured to provide a flow of gaseous fuel to the tube 224. It should be appreciated that any appropriate fuel manifold structure may be included with the burner assembly 200.

Embodiments of the burner assembly 200 provided herein may overcome issues related to inward fired burner assemblies, such as related to a limited area of a central combustion zone. Embodiments provided herein may further improve combustion efficiency and/or power density (e.g., power output per unit burner diameter) relative to inward fired burner assemblies. For instance, recesses 211 and flame ports 214 such as depicted and described herein may facilitate entraining of air and more complete burning of fuel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly for a cooktop appliance, the burner assembly comprising:

an annular burner body forming a plurality of flame ports distributed in adjacent arrangement along a circumferential direction and extending radially inward from a mixing chamber formed at the annular burner body and substantially surrounding a central combustion zone, the plurality of flame ports forming a swirl angle extending between an inlet opening proximate to the mixing chamber and an outlet opening distal to the mixing chamber and adjacent to the central combustion zone, wherein the plurality of flame ports extend at an angle greater than zero degrees and less than 90 degrees, wherein the annular burner body comprises an inner side wall at which the outlet opening of the plurality of flame ports is formed, and wherein a recess is formed at the inner side wall between a circumferentially adjacent pair of flame ports, wherein the inlet opening is positioned radially outward of the outlet opening relative to a center point at the central combustion zone, and wherein an angle of an inner wall of the flame ports extending between the inlet opening and the outlet opening is between approximately 80 degrees and approximately 100 degrees relative to a first wall of the recess extending from a leading edge of the outlet opening toward a nadir of the recess.

2. The burner assembly of claim 1, wherein the recess comprises a second wall extending from the nadir to the outlet opening of a second flame port circumferentially adjacent to the first flame port.

3. The burner assembly of claim 2, wherein the first wall extends from a leading edge of the outlet opening at the first flame port, and wherein the second wall extends from a trailing edge of the outlet opening at the second flame port.

4. The burner assembly of claim 3, wherein an angle between the first flame port and the first wall is between 75 degrees and 100 degrees.

5. The burner assembly of claim 3, wherein an angle between the first flame port and the first wall is approximately 90 degrees.

6. The burner assembly of claim 1, wherein the plurality of flame ports extends substantially straight between the inlet opening and the outlet opening.

7. The burner assembly of claim 6, wherein the plurality of flame ports extends for a distance approximately double or greater of a hydraulic diameter of the outlet opening.

8. The burner assembly of claim 1, wherein the recess formed between circumferentially adjacent pair of flame ports generates a substantially uniform reaction zone around a circumference of a plurality of flames extending from the flame ports during operation.

9. The burner assembly of claim 1, wherein the recess formed between circumferentially adjacent pair of flame ports generates a clear spacing between flames generated from the plurality of flame ports.

10. A cooktop appliance, comprising:

a cabinet configured to receive an inward fired burner assembly, the inward fired burner assembly comprising an annular burner body forming a plurality of flame ports distributed in adjacent arrangement along a circumferential direction and extending radially inward from a mixing chamber formed at the annular burner body and substantially surrounding a central combustion zone, the plurality of flame ports forming a swirl angle extending between an inlet opening proximate to the mixing chamber and an outlet opening distal to the mixing chamber and adjacent to the central combustion zone, wherein the plurality of flame ports extend at an angle greater than zero degrees and less than 90 degrees, wherein the annular burner body comprises an inner side wall at which the outlet opening of the plurality of flame ports is formed, and wherein a recess is formed at the inner side wall between a circumferentially adjacent pair of flame ports, wherein the inlet opening is positioned radially outward of the outlet opening relative to a center point at the central combustion zone, and wherein an angle of an inner wall of the flame ports extending between the inlet opening and the outlet opening is between approximately 80 degrees and approximately 100 degrees relative to a first wall of the recess extending from a leading edge of the outlet opening toward a nadir of the recess.

11. The cooktop appliance of claim 10, wherein the recess comprises a second wall extending from the nadir to the outlet opening of a second flame port circumferentially adjacent to the first flame port.

12. The cooktop appliance of claim 11, wherein the first wall extends from a leading edge of the outlet opening at the first flame port, and wherein the second wall extends from a trailing edge of the outlet opening at the second flame port.

13. The cooktop appliance of claim 12, wherein an angle between the first flame port and the first wall is between 75 degrees and 100 degrees.

14. The cooktop appliance of claim 12, wherein an angle between the first flame port and the first wall is approximately 90 degrees.

15. The cooktop appliance of claim 10, wherein the plurality of flame ports extends substantially straight between the inlet opening and the outlet opening.

16. The cooktop appliance of claim 15, wherein the plurality of flame ports extends for a distance approximately double or greater of a hydraulic diameter of the outlet opening.

17. The cooktop appliance of claim 10, wherein the recess formed between circumferentially adjacent pair of flame ports generates a substantially uniform reaction zone around a circumference of a plurality of flames extending from the flame ports during operation.

18. The cooktop appliance of claim 10, wherein the recess formed between circumferentially adjacent pair of flame ports generates a clear spacing between flames generated from the plurality of flame ports.

* * * * *